US005365608A

United States Patent [19]

Flick

[11] Patent Number: 5,365,608

[45] Date of Patent: Nov. 22, 1994

[54] DISPOSABLE, ELASTOMERIC GLOVE

[76] Inventor: Conrad Flick, 3715 ½ State St., Bettendorf, Iowa 52722

[21] Appl. No.: 916,437

[22] Filed: Jul. 21, 1992

[51] Int. Cl.[5] ..... A41D 19/00

[52] U.S. Cl. ..... 2/168; 2/161.7; 2/162

[58] Field of Search ..... 2/158, 159, 161 R, 160, 2/168, 169, 21, 167, 162, 16, 161.6, 161.7, 161.8, 901

[56] References Cited

U.S. PATENT DOCUMENTS

| | | | |
|---|---|---|---|
| 1,578,127 | 3/1926 | Hynes | 2/158 |
| 2,106,348 | 1/1938 | Hall et al. | 2/168 |
| 2,207,614 | 7/1940 | Copen | 2/21 |
| 2,325,482 | 7/1943 | Curran | 2/159 |
| 4,218,778 | 8/1980 | Stansbury | 2/163 |
| 4,399,567 | 8/1983 | Weon Joong | 2/161 R |
| 4,464,796 | 8/1984 | Heissenberger et al. | 2/168 |
| 4,876,747 | 10/1989 | Coffey et al. | 2/168 |
| 5,020,160 | 6/1991 | Cano | 2/159 |

FOREIGN PATENT DOCUMENTS

| | | | |
|---|---|---|---|
| 1260201 | 9/1989 | Canada | 2/168 |
| 1191135 | 10/1959 | France | 2/168 |
| 2282847 | 3/1976 | France | 2/168 |
| 1526635 | 12/1989 | U.S.S.R. | 2/161 R |

*Primary Examiner*—Clifford D. Crowder
*Assistant Examiner*—Amy B. Vanatta
*Attorney, Agent, or Firm*—Bradford E. Kile; Ruffin B. Cordell; Kevin M. O'Brien

[57] ABSTRACT

A disposable elastomeric glove having a distinct protuberance in proximal position with respect to an abductor pollicis longus muscle of a wearer and between a proximal edge of a cuff and a wrist region of the glove.

12 Claims, 3 Drawing Sheets

DISPOSABLE, ELASTOMERIC GLOVE

BACKGROUND OF THE INVENTION

This invention relates to a novel , disposable, elastomeric glove. More specifically, this invention relates to a disposable elastomeric glove which may be facilely removed by a wearer while hygienically maintaining isolation integrity of the wearer's hands from any contaminant on the exterior surface of the glove.

The use of an elastomeric glove by medical and laboratory professionals to prevent the tactile transfer of foreign materials during various procedures has been known for years. Originally a predominant interest of health care professionals was to maintain a sterile interface to isolate a patient from contamination by the health care provider. More recently, with the explosion of body fluid transmitted diseases, such as acquired immune deficiency syndrome (AIDS), etc., health care professionals are equally concerned about maintaining uncompromising isolation integrity with respect to the body fluid of a patient. This has dramatically increased the need for and use of disposable, elastic gloves not only by traditional health care providers such as operating theater personnel but also in dental offices, external medicine, etc. Moreover, in ever expanding arenas of human contact such as sports trainers, law enforcement, beauticians, etc. wearing disposable rubber gloves is becoming a precaution of preference.

Protective gloves are typically formed of a thin gauge elastomeric material, such as latex or natural rubber, so as not to impair a wearer's tactile sense. The elastomeric material is designed to stretch around and intimately conform to the hand of a wearer and thus not interfere with the performance of a delicate procedure by bunching of excess material. This close conforming fit by a relatively thin gauge elastomeric material makes removal of the gloves somewhat difficult.

The foregoing advantages attendant the fabrication of elastomeric gloves composed of a thin film with an intimate fit are highly desirable in terms of glove utility but present significant complications when it is desirable to quickly remove and/or replace a glove. In this, a snug fitting glove is not easily removed and is subject to stretch and binding at various locations of a wearer's hand. This complication is exacerbated when it is realized that there may be fluid on the exterior surface of the glove and it is essential not to allow any contaminant to contact a wearer's skin.

In the past, there have been various methods for removing elastomeric gloves. One common technique is to insert a thumb or finger of an opposite hand under a beaded edge of a cuff of the glove in a central location on the palm side of the glove and peel the glove from the hand. This method favorably inverts the glove during the removal process to essentially contain most of the contamination fluid within the inverted glove. One disadvantage occasioned with this method arises with the insertion of the opposing, gloved finger within the cuff opening. During most procedures involving elastomeric gloves the exterior surface of the glove is exposed to biological or chemical contaminants or the like. When utilizing the foregoing technique of digital glove removal it becomes virtually impossible to be certain that physical contact will not occur with the wrist or arm by the contaminated, gloved finger due to the tight fitting cuff about the wrist. Moreover, a nail of an inserting thumb or finger may accidentally scrape exposed wrist skin through the glove material. With a growing concern about AIDS, contacting any tissue surface of a health care provider with contaminated, gloved surfaces is highly undesirable.

Another method of doffing a rubber glove is to grasp cuff material with one's fingertips and distally pull the glove. A disadvantage of this technique is that if the glove material is taut, it is difficult to grasp and, once grasped, tends to bind at the base of the palm. Removal from this point is difficult as the muscles of the thenar eminence restrict movement and impair reverse rolling of the glove. Moreover, the material is thin and susceptible to tearing if undue force is applied. Moreover, a fingernail of the wearer may puncture the glove.

Several designs have previously been known which implement a tab component as a means of securement and removal. In one such embodiment, a cusp shaped tab element is integrally formed with the front and back panels of a glove at the proximal cuff end to facilitate removal. In still another embodiment, a tab is formed by a small flat extension of the elastomeric glove material at the proximal edge of the glove opening. This flap lies abutting the wrist in most instances. A problem common to previously known tab designs arises in the removal by attempting to grasp the tab in the wrist abutting position without contacting unprotected skin by the opposing gloved hand.

In another embodiment the tab lies in a similar placement and is used to secure the free end of a cuff portion for tightening the cuff when the glove is on the wearer's hand. If the tab is in contact with the glove surface, grasping the tab edge may be difficult with the other gloved hand. In addition the manufacture involves attachment of a second element; the actual tab and/or the removable adhesive shield.

Another embodiment actually establishes a predetermined tear line with an adjacent gripping area, such as a textured area, tab, hole, or the like. A similar problem of contacting unprotected skin by the opposing, gloved hand when attempting to remove the glove exists. Once the glove is removed, the glove has no structured shape and the outer contaminated surfaces are exposed.

In yet another embodiment, a raised loop is attached to the back portion of the wrist to facilitate removal by pulling distally with opposing hand or with a separate hook device to avoid exposed skin contact. This design however, does not avoid binding at the wrist in the region of the thenar eminence.

Although previously known elastomeric gloves have received considerable use, it would be highly desirable to provide a glove which would be safe in use, easy to remove, inexpensive to manufacture, and adapts to various hands. The foregoing should be advantageously achieved with a unit which is efficient in design and possesses a high degree of isolation integrity from patient fluids. Still further, it would be desirable to provide an elastomeric glove with the foregoing characteristics and in addition can be worn on either hand and is inside-out reversible.

The difficulties and limitations suggested in the preceding and desired features are not intended to be exhaustive but rather are among many which may tend to reduce the effectiveness and user satisfaction with prior disposable, elastomeric gloves. Other noteworthy problems and limitations may also exist; however, those presented above should be sufficient to demonstrate that disposable, elastomeric gloves appearing in the past will admit to worthwhile improvement.

OBJECTS AND BRIEF SUMMARY OF THE INVENTION

It is therefore a general object of the invention to provide a novel disposable, elastomeric glove which will obviate or minimize problems of the type previously described.

It is a specific object of the invention to provide a disposable, elastomeric glove having an integral provision which facilitates safe, selective removal.

It is another object of the invention to provide a disposable, elastomeric glove which may be facilely removed in a manner which utilizes glove inversion to isolate contaminated fluid from a user and those around the user.

It is still another object of the invention to provide a novel, elastomeric glove having a facile removal capability which does not interfere nor distract from performing conventional health care procedures.

It is a related object of the invention to provide a disposable, elastomeric glove having a doffing means operable for insuring the safe removal of the glove.

It is a still another object of the invention to provide a novel, disposable, glove which will be operable to be safely and rapidly doffed without catching and stretching over the abductor pollicis longus muscle.

It is yet another object of the invention to provide a disposable, elastomeric glove which requires no external devices or persons to assist in removal.

It is still another object of the invention to provide a disposable, elastomeric glove which permits the safe donning and doffing of the glove while being suitable for manufacture by previously known dipping techniques.

It is yet still another object of the invention to provide a disposable, elastomeric glove which may be ambidextrous and/or inside-out reversible.

It is a further object of the invention to provide a disposable, elastomeric glove which may be facile adjusted during use without contaminating a wearer.

BRIEF SUMMARY OF A PREFERRED EMBODIMENT OF THE INVENTION

A preferred embodiment of the invention which is intended to accomplish at least some of the foregoing objects entails a disposable elastomeric glove having a distinct protuberance in proximal position with respect to the abductor pollicis longus muscle and between a proximal edge of a cuff of and a wrist region of the glove. In a preferred embodiment this protuberance has a smooth generally uniform conical surface with a concave summit area.

THE DRAWINGS

Other objects and advantages of the present invention will become apparent from the following detailed description of preferred embodiments thereof taken in conjunction with the accompanying drawings wherein.

Figure 12:
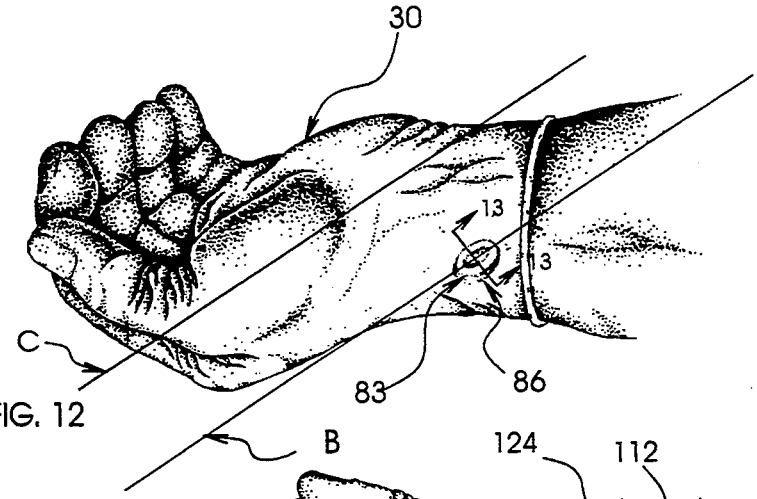
FIG. 12 is an axonometric view disclosing still another embodiment of the invention wherein a glove removal protrusion is fabricated with an elliptical apex region.
Figure 13:
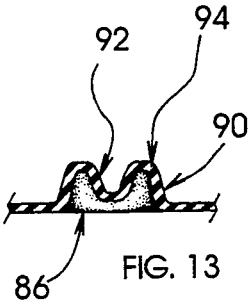
Figure 14:
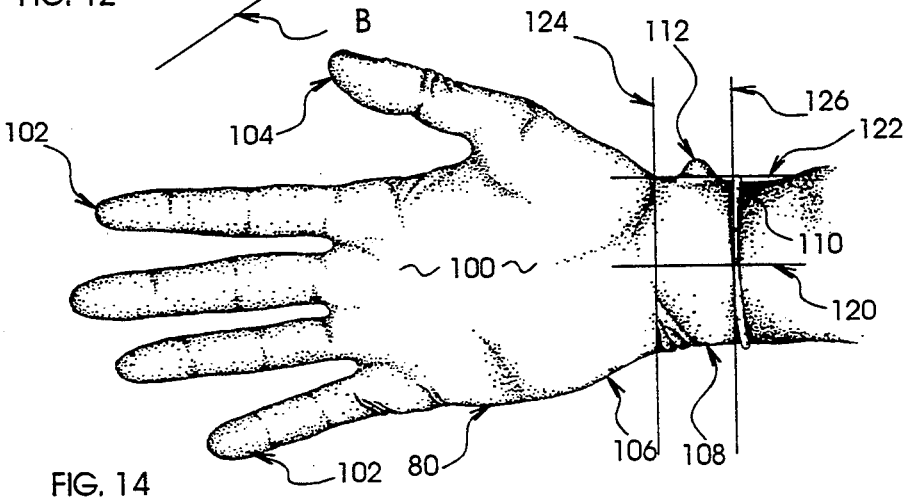

FIG. 13 is an enlarged, partial cross-sectional view; taken along section line 13—13 in FIG. 12, and discloses a generally elliptical rim configuration at the apex of a removal protrusion; and FIG. 14 is a plan view of a disposable, elastomeric glove in accordance with the subject invention wherein the protrusion is located at an edge of a zone of optimum placement and thus the glove may be used with equal facility upon a wearer's right hand or left hand.

DETAILED DESCRIPTION

Context of the Invention

Figure 1:
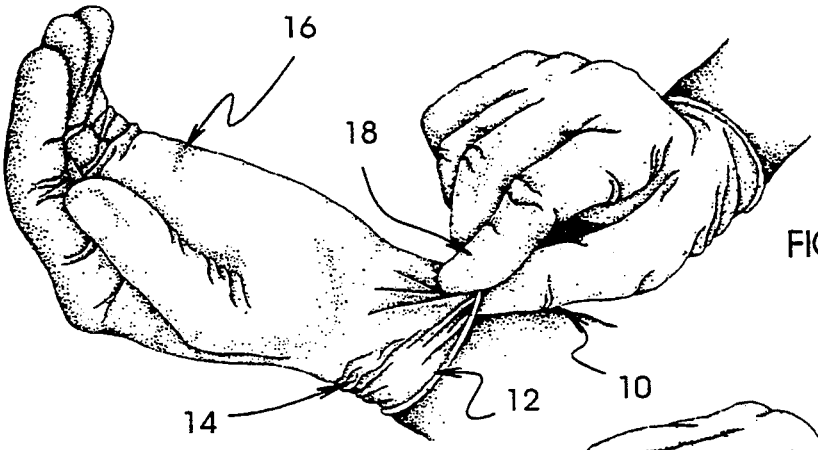
FIG. 1 is an axonometric view of a prior art glove and one technique of removal wherein a rolled cuff of the, disposable, elastomeric glove is grasped between a thumb and forefinger of an opposing hand in approximately a center wrist portion of the glove.
Figure 2:
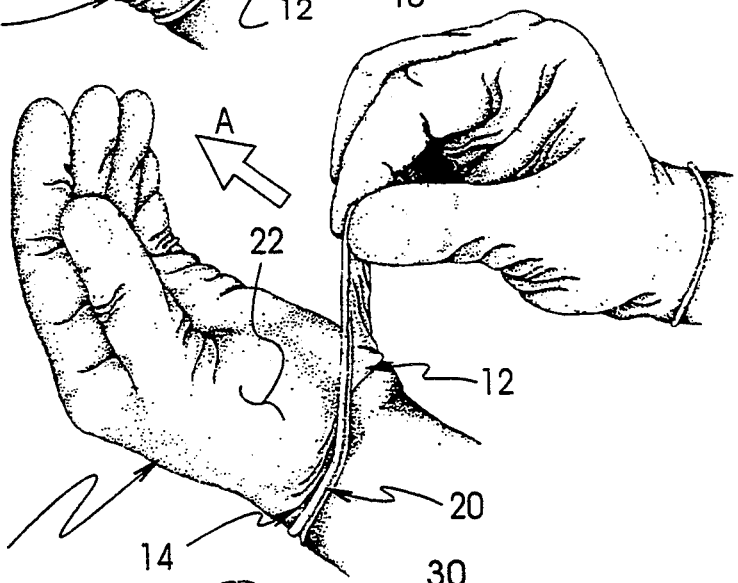
FIG. 2 is another prior art view in sequence with respect to FIG. 1, and discloses a wearer attempting to remove the disposable, elastomeric glove by pulling upwardly and distally on the cuff; however, it will be noted that an edge or lip adjacent the abductor pollicis longus muscle becomes bound and restricts easy removal of the glove.

Referring now particularly to the drawings, wherein like reference characters refer to like parts and particularly to FIGS. 1 and 2, axonometric views will be seen of a general operative environment of the subject invention. In this regard, conventional disposable, elastomeric gloves are shown worn upon the hands of a health care provider, sports trainer, policeman, etc. Following an operative or an examination procedure, or during such procedures, a health care or other professional provider may decide to remove the disposable gloves. In this event, a conventional technique has been to insert a wearer's thumb 10 beneath a lip 12 of a cuff portion 14 of the elastomeric glove 16. The cuff 12 is then grasped between the thumb 10 and forefinger 18 of the wearer's free hand and, as depicted in FIG. 2, an edge of the cuff is lifted and pulled distally in the general direction of arrow A.

In certain instances, the thin elastomeric glove 16 tends to stretch during the removal operation and the ribbed edge 12 of the cuff 14 tends to bind at the wrist region 20 of a wearer. In this connection, the abductor pollicis longus muscle 22 of a wearer's hand tends to form a crease at its base with respect to a wearer's wrist. This crease tends to exacerbate binding of the lip 12 of the cuff 14 and prevent the glove from being easily removed. In this respect, as resistance is offered a user typically applies more force in the general direction of arrow A and often the elastomeric glove tends to stretch and create more resisting force until the force of removal exceeds that of the binding action. In certain instances, the glove may unexpectedly release and flip off in an erratic fashion spraying contaminants into the ambient environment.

Disposable Elastomeric Glove

Figure 3:
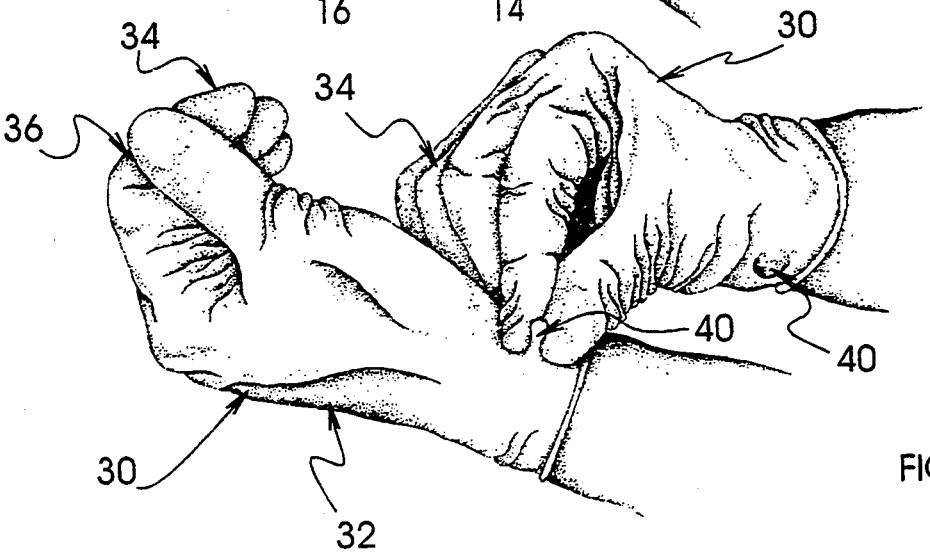
FIG. 3 is an axonometric view of a disposable, elastomeric glove in accordance with the subject invention wherein a wearer is beginning the removal process by grasping a protrusion or tab between the cuff and base of the thumb with a thumb and index finger of an opposing hand.

A pair of disposable elastomeric gloves in accordance with the subject invention is disclosed in connection with FIG. 3. In this regard, each elastomeric glove 30 includes a body portion 32, finger portions 34 and a thumb portion 36 within a unitary envelope in a conventional manner. Each glove is composed of a relatively thin film of elastomeric material such as latex or natural rubber or a plastic composition having a property of elasticity and is designed to snugly fit over the hand of a wearer to facilitate tactile sense while isolating the hand of a wearer from contamination. When it is desired to remove the disposable, elastomeric glove the subject invention includes a protrusion 40 which is integrally joined with the glove in a location between a proximal edge of a cuff region of the glove and a wrist region of the glove in a manner which will be discussed in detail below.

Figure 4:
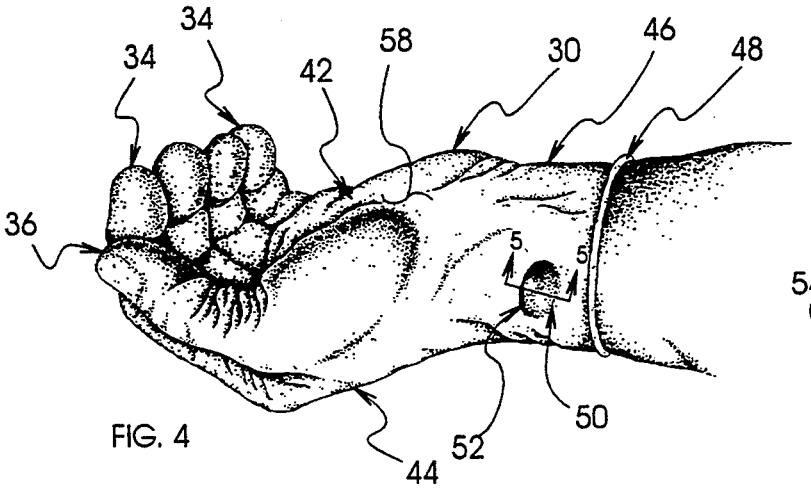
FIG. 4 is an axonometric view of one first embodiment of the subject disposable, elastomeric glove invention wherein a protrusion is positioned between the cuff and abductor pollicis longus muscle to facilitate removal of the glove from a wearer's hand.
Figure 5:
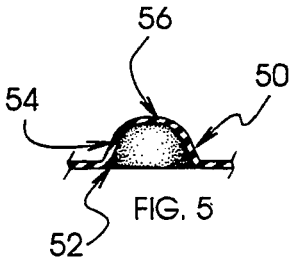
FIG. 5 is an enlarged partial cross-sectional view taken along section line 5—5 in FIG. 4 and discloses one embodiment of the protrusion configuration as comprising a generally hollow, conical segment having an elongate or elliptical base.

Turning now to FIGS. 4 and 5, there will be seen one preferred embodiment of the subject invention. In this regard, an elastomeric glove 30 is fashioned in a conventional manner as discussed above and includes a body portion having a generally flat surface 42 covering a wearer's palm and an opposing surface 44 covering the back of a wearer's hand. The glove includes conventional finger elements 34 and an enclosure 36 for a thumb. A cuff 46 is integrally fashioned with the body portion of the glove and is operable to extend along a wearer's wrist. The cuff segment 46 typically terminates with a beaded ring 48 defining the proximal end of the elastomeric glove. The bead 48 snugly surrounds a wearer's wrist and is designed to prevent contaminants from entering an interior portion of the glove around the region of the wrist.

The subject inventive glove includes means for facilely removing or doffing or adjusting the glove as discussed in connection with FIG. 3. In this regard, a protrusion 50 is depicted in FIG. 4 having the general shape of a cone with a rounded apex. The protrusion 50 includes a generally elliptical shaped base 52 and side segments 54, note FIG. 5. The protrusion 50 terminates at a rounded apex 56 and, as depicted in cross section in FIG. 5, the protrusion is a generally hollow thin film extension of the cuff region of the glove. The protrusion 50 is mounted in a location between the proximal edge or lip 48 of the cuff 46 and a base 58 of a wearer's thumb. This location enables a wearer to peel the glove cuff and glove over a wearer's abductor pollicis longus muscle without binding of the edge 48 of the cuff upon a wearer's wrist.

Although an elliptical hose is preferred circular base can be utilized to advantage. In addition, the protrusion 50 is reversible and may be extended in an opposite direction such that the glove may be turned inside out and utilized on an opposite hand.

Figure 6:
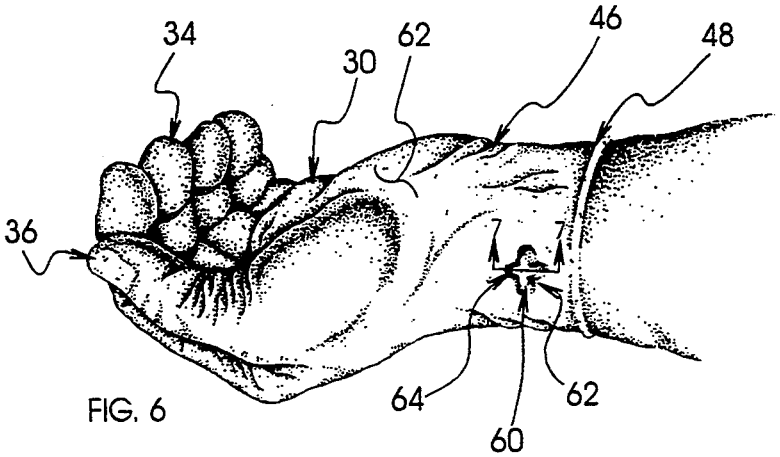
FIG. 6 is an axonometric view of another embodiment of the subject invention wherein a protrusion operable for facilitating removal of the disposable, elastomeric glove has a cross-sectional configuration in the form of a cross.
Figure 7:
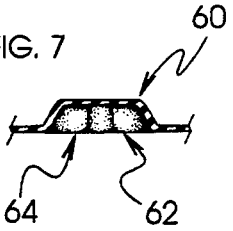
FIG. 7 is an enlarged partial, cross-sectional view taken along section lines 7—7 in FIG. 6 and discloses an alternative arrangement operable for permitting a wearer to facilely remove a disposable, elastomeric glove in accordance with the subject invention.

Turning to FIGS. 6 and 7 there will be seen another preferred embodiment of the invention wherein the elastomeric glove 30 is fashioned with finger and thumb components as noted above, and includes a cuff 46 and elastomeric proximal rim or bead 48. In this embodiment of the invention a protrusion 60 is fashioned into the cuff in a location adjacent the base region 62 of a wearer's thumb. The protrusion 60 comprises a generally raised configuration having a plan configuration in the shape of a cross with legs 62 and 64. As noted in FIG. 7, in this embodiment of the invention there is a generally flat surface provided at the apex of the protrusion and a wearer may operably grasp this protrusion 60 between a thumb and forefinger as depicted in FIG. 3 for facilely removing the glove. In this, and as indicated above the protrusion 60 is reversible and the glove may be turned inside-out for ambidextrous use.

Figure 8:
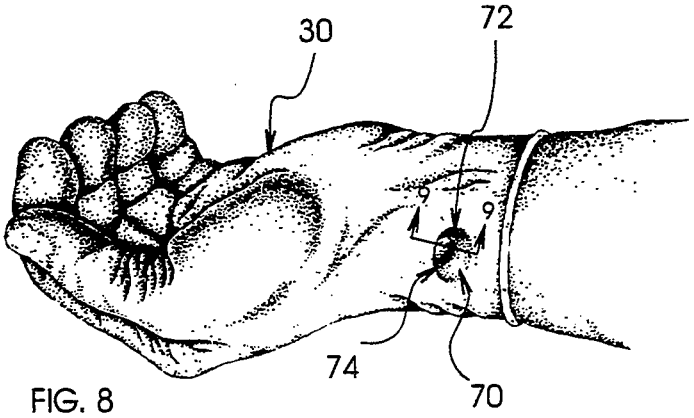
FIG. 8 is an axonometric view of a further embodiment of the subject disposable, elastomeric glove invention wherein a protrusion is fashioned in a generally conical configuration.
Figure 9:
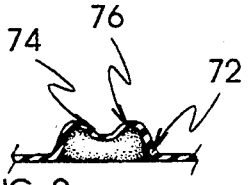
FIG. 9 is an enlarged, partial, cross-sectional view taken along section line 9—9 in FIG. 8 and discloses an embodiment wherein the apex of the cone has a concave.

FIGS. 8 and 9 disclose yet another embodiment of the invention wherein a disposable elastomeric glove 30 is fashioned with a protrusion 70 operable to facilitate removal or adjustment of the glove with respect to a wearer's hand. In this specific embodiment, as particularly shown in FIG. 9, a generally conical protrusion includes a base 72 having a generally elliptical or round configuration which extends upwardly therefrom to a generally curved apex 74. Instead of the apex extending outwardly however, as depicted in the embodiment of FIGS. 4 and 5, the apex 74 of the subject embodiment is generally concave, as at 76, and operably extends inwardly toward the arm of a wearer. This reversely folded material enables a wearer to facilitate gripping action between a thumb and forefinger and thus removal of the glove when desired. This is the best mode contemplated by the inventor, at the time of filing the application, for practicing the subject invention.

Figure 10:
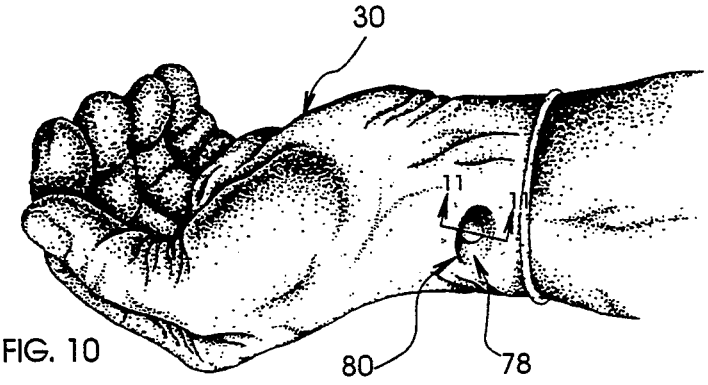
FIG. 10 is an axonometric view disclosing yet another embodiment of the subject invention wherein a glove removal protrusion is fashioned with an extension portion.
Figure 11:
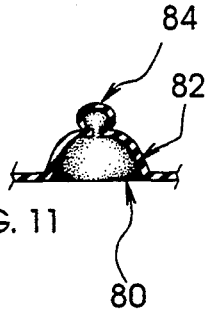
FIG. 11 is an enlarged, partial cross-sectional view, taken along section line 11—11 in FIG. 10, and discloses a generally spherical extension element to facilitate removal of the glove.

FIGS. 10 and 11 depict a further embodiment of the subject invention wherein a disposable elastomeric glove 30 is fabricated with an outwardly extending protrusion 78 in a location between a cuff of the glove and a base portion of the wearer's thumb. The protrusion 78 includes a generally elliptical base 80 with upstanding sidewalls 82 as particularly illustrated in FIG. 11. In this respect, this configuration is similar to that depicted in FIGS. 4 and 5. This embodiment, however, has an additional extension 84 fashioned at the apex of the lateral wall surfaces 82. This extension 84 may take the configuration of a hollow sphere as depicted or an elongate member having a longitudinal axis in the general direction of that of the longitudinal axis of the elliptical base portion 80 of the protrusion. In addition, although the drawing 11 depicts the extension 84 as being hollow it may in fact be fabricated of a solid latex or natural rubber bead and is designed to further assist gripping between a thumb and forefinger of a wearer during a glove doffing or adjustment sequence.

FIGS. 12 and 13 depict yet another embodiment of the subject invention wherein a disposable elastomeric glove 30 includes a protrusion 86 having a generally elliptical base 88 and conically extending sidewalls 90. The apex of the protrusion 86 is concave at 92, note particularly FIG. 13, but includes a elliptical flat ring 94 which facilitates gripping action by a wearer between a wearer's thumb and forefinger.

This embodiment also discloses a preferred orientation of the major axis of the elliptical base as being substantially parallel with an imaginary line drawn through an imaginary axis of the as depicted by parallel lines B and C. This orientation facilitates pulling of a cuff of the glove over the abductor pollicis longus muscle of a wearer.

The foregoing discussion in connection with FIGS. 4–13 depicted various embodiments of the subject invention. Each of these embodiments are illustrative, and are not intended to be exhaustive of the advantageous configurations that may be conceived utilizing the subject invention concepts. At the time of filing of the application for patent applicant believes that the embodiment depicted in FIGS. 8 and 9 is the best mode of practicing the invention although the all other embodiments are also advantageous and may be utilized by those of skill in the art.

Turning to FIG. 14 there is depicted a plan view of a hand wearing a disposable, elastomeric glove in accordance with yet another embodiment of the invention. In this, an elastomeric glove 30 is composed of the conventional body portion 100, fingers 102 and thumb portion 104. The body 100 includes a palm element 106 and a corresponding back of the hand element (not shown). In addition, a cuff region 108 extends from the proximal location of the body portion and terminates in an annular rib or bead 110 operable to snugly engage a wearer's wrist. In this embodiment, a protrusion 112 is positioned between a bead portion 110 and a base of the thumb segment 104 of the glove cuff. This protrusion 112 may be fashioned in the configuration of any of the prior embodiments depicted in FIGS. 4–13. The location of this protrusion 12 is at the edge of the glove as it lays flat in the manner shown in FIG. 14. Thus this particular arrangement may be advantageously utilized as an ambidextrous glove such that it may be fitted onto a wearer's left hand or right hand with equal facility. In either instance, however, the protrusion 112 is positioned inside the cuff bead 110 and will operably permit a wearer to grasp the protrusion 112 in a manner illustrated particularly in FIG. 3 and pull the cuff over the abductor pollicis longus muscle to facilely removing a contaminated glove.

In describing various illustrative, preferred embodiments of the subject invention, with respect to FIGS. 4–13, it has been found that it is advantageous to locate a protrusion in a generally rectangular area of the glove which occupies the same side of the glove as the thumb segment of the glove. Referring specifically again to FIG. 14, a first .imaginary line 120 has been drawn as a general extension of the middle finger of the wearer which tends to bisect the wearer's wrist and the palm of the wearer's hand. This first imaginary line 120 has a companion parallel line 122 which extends along an outer edge of the wearer's wrist in the direction of the wearer's thumb. A further imaginary line 124 may be extended transversely across a wearer's wrist at the base of the thumb 104 and a parallel line 126 extend inside the annular bead at the proximal cuff region of the glove. The imaginary lines 120, 122, 124, and 126 operably defined a generally rectangular region 128 which advantageously is a preferred location for locating the protrusion of any of the embodiments depicted in FIGS. 4–13, and equivalent embodiments thereof. With this positioning a wearer may advantageously grasp the protrusion and pull it over the abductor pollicis longus muscle to rapidly remove or doff the glove following use.

SUMMARY OF MAJOR ADVANTAGES OF THE INVENTION

In describing a disposable, elastomeric glove in accordance with preferred embodiments of the invention, those skilled in the art will recognize several advantages which singularly distinguish the invention from the heretofore known prior art. A particular advantage is the provision of a protrusion located between the proximal cuff rim or bead of a glove and the base of the wearer's thumb such that the cuff may be facilely pulled over the abductor pollicis longus muscle to rapidly remove the glove without binding.

The region 128 of the glove may be advantageously used to mount the protrusion to optimally pull the cuff of the glove over the abductor pollicis longus muscle. In addition, the subject protrusion may be readily manufactured by conventional elastomeric glove dipping techniques and is positioned away from interfering conflict with procedures normally attendant with those who need to wear protective elastomeric gloves.

The protrusion may be advantageously oriented to further enhance removal as shown in FIG. 12. The protrusion is reversible and a glove with the subject protrusion may be inside-out revisable and worn on either hand.

The subject protrusion feature while sewing a primary function of enhancing a removal procedure may be synergistically utilized as an adjustment tool during a normal procedure.

The specific embodiments of the subject invention as depicted in the drawings are illustrative and are not intended to be exhaustive of all equivalence thereof. In these embodiments a protrusion is provided to enable a wearer to remove a snug fitting glove in a smooth removal stroke without binding or undue force.

In describing the invention, reference has been made to preferred embodiments. Those skilled in the art, however, and familiar with the disclosure of the subject invention may recognize additions, deletions, substitution modifications and/or other changes which will fall within the purview of the invention as defined in the following claims.

What is claimed is:

1. A disposable, elastomeric glove operable for safe removal without subjecting a wearer to contaminants on an exterior surface of the glove, said glove comprising:

an elastomeric envelope configured into the shape of a human hand including four finger segments, a thumb segment, a body portion and a smooth, peripheral cuff; and means for facilitating safe removal of said glove from the hand of a wearer comprising a protuberance extending outwardly from the smooth, peripheral cuff surface of said glove and being positioned upon the cuff of said glove substantially entirely within a location bound by a generally rectangular region of the cuff defined by a first imaginary line longitudinally bisecting a palm surface of the body portion of the glove, a longitudinal edge of the glove cuff extending generally parallel with said first imaginary line and adjacent to the base of the thumb segment, a second imaginary line extending generally normal to said first imaginary line at the base of the thumb segment and an outward edge of said cuff, wherein a wearer of said glove may operably grasp said protuberance between a thumb and index finger of an opposing hand and peel the glove over the base of the thumb of the glove and invert the glove with a facile removal process.

2. A disposable, elastomeric glove operable for safe removal without subjecting a wearer to contaminants on an exterior surface of the glove as defined in claim 1 wherein said protuberance comprises:

a raised, hollow member.

3. A disposable, elastomeric glove operable for safe removal without subjecting a wearer to contaminants on an exterior surface of the glove as defined in claim 2 wherein said raised, hollow, member comprises:

a generally conical protrusion with a rounded apex and a circular base.

4. A disposable, elastomeric glove operable for safe removal without subjecting a wearer to contaminants on an exterior surface of the glove as defined in claim 2 wherein said raised, hollow member comprises:

a generally conical protrusion with a cross-shaped configuration in plan view.

5. A disposable, elastomeric glove operable for facilitating safe removal without subjecting a wearer to contaminants on an exterior surface of the glove as defined in claim 2 wherein said raised, hollow, member comprises:

a generally conical protrusion with a concave depression located at the apex of the conical protrusion.

6. A disposable, elastomeric glove operable for facilitating safe removal without subjecting a wearer to contaminants on an exterior surface of the glove as defined in claim 2 wherein said raised, hollow member comprises:

a generally conical protrusion with a spherical portion fashioned at the apex of said conical protrusion.

7. A disposable, elastomeric glove operable for safe removal without subjecting a wearer to contaminants on an exterior surface of the glove as defined in claim 2 wherein said raised hollow member comprises:

a generally conical protrusion having a generally elliptical configured base and upper rim and a concave area at an apex of the conical protrusion.

8. A disposable, elastomeric glove operable for safe removal without subjecting a wearer to contaminants on an exterior surface of the glove as defined in claim 2 wherein said raised hollow member comprises:

a generally conical protrusion mounted upon said longitudinal edge of the glove cuff extending generally parallel with said first imaginary line such that said disposable, elastomeric glove may be worn on either the right hand or left hand of a user.

9. A disposable, elastomeric glove operable for safe removal without subjecting a wearer to contaminants on an exterior surface of the glove, said glove comprising:

an elastomeric envelope configured into the shape of a human hand including four finger segments, a thumb segment, a body portion and a cuff; and means for facilitating safe removal of said glove from the hand of a wearer comprising a protuberance, said protuberance being a raised hollow member extending outwardly from the surface of said glove and being positioned upon the cuff of said glove within a location bound by a generally rectangular region of the cuff defined by a first imaginary line longitudinally bisecting a palm surface of the body portion of the glove, a longitudinal edge of the glove cuff extending generally parallel with said first imaginary line and adjacent to the base of the thumb segment, a second imaginary line extending generally normal to said first imaginary line at the base of the thumb segment and an outward edge of said cuff, said raised, hollow member comprising, a generally conical protrusion with a rounded apex and a generally elliptical base having a long axis of the elliptical base extending generally transverse to said first imaginary line;

wherein a wearer of said glove may operably grasp said protuberance between a thumb and index finger of an opposing hand and peel the glove over the base of the thumb of the glove and invert the glove with a facile removal process.

10. A disposable, elastomeric glove operable for safe removal without subjecting a wearer to contaminants on an exterior surface of the glove, said glove comprising:

an elastomeric envelope configured into the shape of a human hand including four finger segments, a thumb segment, a body portion and a cuff; and means for facilitating safe removal of said glove from the hand of a wearer comprising a protuberance, said protuberance being a raised hollow member extending outwardly from the surface of said glove and being positioned upon the cuff of said glove within a location bound by a generally rectangular region of the cuff defined by a first imaginary line longitudinally bisecting a palm surface of the body portion of the glove, a longitudinal edge of the glove cuff extending generally parallel with said first imaginary line and adjacent to the base of the thumb segment, a second imaginary line extending generally normal to said first imaginary line at the base of the thumb segment and an outward edge of said cuff, said raised, hollow member comprising, a generally conical protrusion with a concave depression located at the apex of the conical protrusion, and said generally conical protrusion is fashioned with a generally elliptical base having a long axis of the elliptical base extending to form an acute angle with respect to said first imaginary line;

wherein a wearer of said glove may operably grasp said protuberance between a thumb and index finger of an opposing hand and peel the glove over the base of the thumb of the glove and invert the glove with a facile removal process.

11. A disposable, elastomeric glove operable for safe removal without subjecting a wearer to contaminants on an exterior surface of the glove, said glove comprising:

an elastomeric envelope configured into the shape of a human hand including four finger segments, a thumb segment, a body portion and a cuff; and means for facilitating safe removal of said glove from the hand of a wearer comprising a protuberance, said protuberance being a raised hollow member extending outwardly from the surface of said glove and being positioned upon the cuff of said glove within a location bound by a generally rectangular region of the cuff defined by a first imaginary line longitudinally bisecting a palm surface of the body portion of the glove, a longitudinal edge of the glove cuff extending generally parallel with said first imaginary line and adjacent to the base of the thumb segment, a second imaginary line extending generally normal to said first imaginary line at the base of the thumb segment and an outward edge of said cuff, said raised, hollow member comprising, a generally conical protrusion with a spherical portion fashioned at the apex of said conical protrusion, and said generally conical protrusion is fashioned with a generally elliptical base having a long axis of the elliptical base extending to form an acute angle with respect to said first imaginary line;

wherein a wearer of said glove may operably grasp said protuberance between a thumb and index finger of an opposing hand and peel the glove over the base of the thumb of the glove and invert the glove with a facile removal process.

12. A disposable, elastomeric glove operable for safe removal without subjecting a wearer to contaminants on an exterior surface of the glove, said glove comprising:

an elastomeric envelope configured into the shape of a human hand including four finger segments, a thumb segment, a body portion and a cuff; and means for facilitating safe removal of said glove from the hand of a wearer comprising a protuberance, said protuberance being a raised hollow member extending outwardly from the surface of said glove and being positioned upon the cuff of said glove within a location bound by a generally rectangular region of the cuff defined by a first imaginary line longitudinally bisecting a palm surface of the body portion of the glove, a longitudinal edge of the glove cuff extending generally parallel with said first imaginary line and adjacent to the base of the thumb segment, a second imaginary line extending generally normal to said first imaginary line at the base of the thumb segment and an outward edge of said cuff, said raised, hollow member comprising, a generally conical protrusion having an elliptical base and the long axis of said elliptical base extending to form an acute angle with respect to said first imaginary line and further extending substantially parallel to a longitudinal axis of a portion of the thumb segment operable to receive the abductor pollices longus muscle of a user;

wherein a wearer of said glove may operably grasp said protuberance between a thumb and index finger of an opposing hand and peel the glove over the base of the thumb of the glove and invert the glove with a facile removal process.

* * * * *